United States Patent [19]

Faulring et al.

[11] 4,373,948

[45] Feb. 15, 1983

[54] ADDITION AGENTS FOR IRON-BASE ALLOYS

[75] Inventors: Gloria M. Faulring, Niagara Falls; Alan Fitzgibbon, Lewiston; Frank Slish, Grand Island, all of N.Y.

[73] Assignee: Union Carbide Corporation, Danbury, Conn.

[21] Appl. No.: 249,510

[22] Filed: Mar. 31, 1981

[51] Int. Cl.[3] ..... C21C 7/00

[52] U.S. Cl. ..... 75/57; 75/53

[58] Field of Search ..... 75/53, 57, 58, 129

[56] References Cited

U.S. PATENT DOCUMENTS

| | | | |
|---|---|---|---|
| 2,386,486 | 5/1958 | Brennan | 75/27 |
| 2,935,397 | 5/1960 | Saunders | 75/44 |
| 2,999,749 | 9/1961 | Saunders | 75/58 |
| 3,591,367 | 7/1971 | Perfect | 75/129 |
| 3,801,308 | 4/1974 | Gustison | 75/53 |

FOREIGN PATENT DOCUMENTS 833098 4/1960 United Kingdom .

OTHER PUBLICATIONS

"Development of Exothermic Vanadium Oxide Addition Agents" (Dec. 26, 1946).

"Electromelt" *Bulletin EMC-65* (Mar., 1957).

*Primary Examiner*—P. D. Rosenberg

*Attorney, Agent, or Firm*—John R. Doherty

[57] ABSTRACT

Addition of a metal selected from niobium, molybdenum, chromium and tungsten to molten iron-base alloys using an agglomerated mixture of a selected metal oxide and calcium-bearing reducing agent.

12 Claims, No Drawings

ADDITION AGENTS FOR IRON-BASE ALLOYS

The present invention is related to the addition of niobium, molybdenum, chromium and tungsten to molten steel.

It is a common requirement in the manufacture of iron-base alloys, e.g., steel, to make additions of niobium, molybdenum, chromium and tungsten to the molten alloy, most commonly in the form of ferroalloys.

It is an object of the present invention to provide additions of the foregoing metals to iron-base alloys, especially steel, which are economical and do not require energy in preparation and which enable the efficient addition of the metal constituents.

Other objects will be apparent from the following descriptions and claims:

The addition agent of the present invention is a blended agglomerated mixture consisting essentially 20 to 80% by weight of an oxide of Nb,Mo, Cr or W and 20 to 80% by weight of a calcium-bearing reducing agent. The source of the oxide may be a chemical process or a mineral, e.g., the oxide of niobium may be the product of a chemical process or a niobium-rich oxidic mineral such as pyrochlore. The reducing agent may be a calcium-silicon alloy. In a preferred embodiment of the present invention, the calcium-silicon alloy used as a reducing agent contains about 28–32% by weight Ca and 60–65% by weight Si primarily as the phases $CaSi_2$ and Si; the alloy may adventitiously contain up to about 8% by weight of iron, and other impurities incidental to the manufacturing process, i.e., the manufacture of calcium-silicon alloy by the electric furnace reduction of CaO and $SiO_2$ with carbon. (Typical analyses: Ca 28–32%, Si 60–65% Fe 5.0%, Al 1.25%, Ba 1.0% and small amounts of impurity elements.)

The closely associated compact or agglomerate of an oxidic material plus reducing agent mixture, is added to the molten steel wherein the heat of the metal bath is sufficient to support the reduction of the oxidic material. The metallic elements generated such as niobium, molybdenum, chromium or tungsten, are immediately integrated into the molten steel. When the oxide-reducing agent mixture is added to the molten metal, contact with slag as well as exposure to oxidizing conditions such as the atmosphere must be minimized to achieve satisfactory recoveries in view of the tendency of the calcium-bearing reducing agent to oxidize. For example, the oxide-reducing agent mixture may be encapsulated and plunged into the molten metal or integrated into and immersed in the pouring stream during the transfer of the metal from the furnace into the ladle. In this case, the ladle should be partially filled before the addition begins. When the reducing agent is a calcium-silicon alloy, CaO and $SiO_2$ are produced during the reduction reaction; and when the reducing agent is silicon, $SiO_2$ is generated and excess silicon is incorporated in the steel as metallic element. The oxides, CaO and $SiO_2$, enter the slag except in aluminum-deoxidized steels; with such steels, the CaO generated reacts with the $Al_2O_3$ inclusion resulting from the aluminum deoxidation.

The following example will further illustrate the present inventions.

EXAMPLE

Procedure: Armco iron was melted in a magnesia-lined induction furnace with argon flowing through a graphite cover. After the temperature was stabilized at 1600°±10° C., the heat was blocked with silicon. Next, except for the oxide-bearing addition, the compositions of the heats were adjusted to the required grade. After stabilizing the temperature at 1600°±5° C. for one minute, a pintube sample was taken for analysis and then the oxide-bearing addition was made by plunging a steel foil envelope containing the compacted or agglomerated oxidic material, or oxidic material plus reducing agent mixture into the molten steel. The steel temperature was maintained at 1600°±5° C. with the power on the furnace for three minutes after addition of the oxide or oxide-reducing agent mixture. Next, the power was shut off and after one minute, pintube samples were taken for analysis and the steel cast into a 100-pound, 10.2 cm (4") ingot. Subsequently, specimens removed from mid-radius the ingot, one-third up from the bottom, were examined microscopically and analyzed chemically. Some were analyzed on the electron microprobe.

Various mixtures of oxidic materials containing niobium, molybdenum, chromium and/or tungsten plus either a commercial grade calcium-silicon alloy or a commercial grade silicon were added in a compacted or agglomerated state to molten steel. For comparison, chromium, tungsten and molybdenum bearing oxidic materials were compacted or agglomerated and added to the molten steel, i.e., no reducing agent was included in the compact or agglomerate. The results of these tests are summarized in Table I.

As can be seen from Table I a closely associated agglomerated mixture of the oxides of the elements niobium, chromium, molybdenum and tungsten, with a reducing agent such as silicon or a calcium-silicon alloy, is an effective, economical, energy-efficient source of these metallic elements in steel when the mixture is added to molten steel. Ores or minerals rich in the required oxidic phase or phases can be used in the mixtures instead of an oxide produced by a chemical process, e.g., pyrochlore as a source of niobium. Contact with the atmosphere and slag should be avoided, or at least minimized, when the compacted or agglomerated mixtures are added to molten steel to avoid oxidation of the reducing agents. The calcium oxide generated during the reduction of the oxidic materials with a calcium-silicon alloy reacts with the alumina inclusions in aluminum-deoxidized steels.

The mesh sizes referred to herein are U.S. Screen series.

TABLE I

| | | OXIDE ADDITIVES FOR STEEL | | | | | | |
|---|---|---|---|---|---|---|---|---|
| | Heat No. | Oxide(1) Identity | % | Reducing(2) Agent Identity | % | Addition Method(3) | Element/ % Added | % Element Recovered in Furnace - "3-Min."(4) |
| Carbon Steel: | | | | | | | | |
| 0.16–0.20% C 0.32–0.40% Si | J779 | $Nb_2O_5$ | 50 | Ca—Si | 50 | P | Nb 0.20 | 95 |

TABLE I-continued

OXIDE ADDITIVES FOR STEEL

| | Heat No. | Oxide(1) Identity | % | Reducing(2) Agent Identity | % | Addition Method(3) | Element/ % Added | % Element Recovered in Furnace - "3-Min."(4) |
|---|---|---|---|---|---|---|---|---|
| 0.91–1.05% Mn<br>0.044–0.054% Al<br>Carbon Steel: | | | | | | | | |
| 0.09–0.12% C<br>0.25–0.42% Si | J801 | $Nb_2O_5$ | 70 | Ca—Si | 30 | B | Nb 0.10 | 90 |
| 1.43–1.56% Mn<br>0.046–0.061% Al | J802 | $Nb_2O_5$ | 70 | Si | 30 | B | Nb 0.10 | 87 |
| | J805 | $MoO_3$ | 80 | Ca—Si | 20 | B | Mo 0.10 | 85 |
| | J806 | $MoO_3$ | 100 | | | B | Mo 0.10 | 69 |
| Carbon Steel: | | | | | | | | |
| 0.12–0.14% C<br>0.10–0.21% Si | J825 | $WO_3$ | 80 | Ca—Si | 20 | B | W 0.10 | 90 |
| 0.81–0.86% Mn<br>0.03–0.04% Al | J826 | $WO_3$ | 100 | | | B | W 0.10 | 60 |
| | J817 | $Nb_2O_5$* | 50 | Ca—Si | 50 | P | Nb 0.10 | 80 |
| | J818 | $Nb_2O_5$* | 70 | Ca—Si | 30 | P | Nb 0.10 | 80 |
| | J827 | $Nb_2O_5$* | 60 | Si | 40 | P | Nb 0.10 | 80 |
| | J863 | $Nb_2O_5$** | 50 | Ca—Si | 50 | P | Nb 0.10 | 90 |
| | J828 | $Cr_2O_3$ | | | | B | Cr 0.20 | 35 |
| | J829 | $Cr_2O_3$ | | Ca—Si | 20 | B | Cr 0.20 | 60 |

(1)Oxide Sources:
$Nb_2O_5$ > 99% pure 100M × D
$MoO_3$ — Tungsten-bearing molybdic oxide-45.4% Mo, 10.64% W, 2.17% S, 0.009% P, 2.1% $SiO_2$ (commercial product, UCC). <48M.
$WO_3$ — Tungsten blue oxide-79.5% W (commercial product, UCC). <100M.
$Nb_2O_5$*— "Niobic" pyrochlore-42.78% Nb (optical spectrographic analyses >10% Ca, 1–10% Na, 1–10% Ti, 0.08–8% Ce, 0.08–8% Fe). <48M.
$Nb_2O_5$**— "Niobic pyrochlore <200M × D.
$Cr_2O_3$ — Commercial grade chrome oxide (England 67.72% Cr. <48M.
(2)Reducing Agents: Calcium-silicon alloy-29.5% Ca, 62.5% Si, 4.5% Fe; trace amounts of Mn, Ba, Al, C, etc. (commercial product, UCC).
8M × D
Silicon >98% pure (commercial product, UCC).
(3)P: Tightly packed in steel foil envelope.
B: Briquetted in hand press with a binder and packed in steel foil envelope.
All additions made by plunging the addition mixtures into the molten steel in the envelopes.
(4)At these levels of additions, 0.10–0.20%, the precision of the percentage recoveries is estimated as ±8%

What is claimed is:

1. An addition agent for adding to molten iron-base alloys a metal selected from the group consisting of Nb, Mo, Cr and W, said addition agent consisting essentially of an agglomerated blended mixture of 20 to 80% by weight of about a finely divided oxide of one of said metals with about 20 to 80% by weight of a finely divided calcium bearing material selected from the group consisting of calcium-silicon alloy, calcium carbide and calcium cyanamide.

2. An addition agent in accordance with claim 1 wherein said calcium-bearing material is calcium-silicon alloy.

3. An addition agent in accordance with claim 1 wherein said calcium-bearing material is calcium carbide.

4. An addition agent in accordance with claim 1 wherein said calcium-bearing material is calcium cyanamide.

5. An addition agent in accordance with claim 1 wherein said oxide is $Nb_2O_5$.

6. An addition agent in accordance with claim 1 wherein said oxide is $WO_3$.

7. An addition agent in accordance with claim 1 wherein said oxide is $MoO_3$.

8. An addition agent in accordance with claim 1 wherein said oxide is $Cr_2O_3$.

9. An addition agent in accordance with claim 1 wherein said oxide is pyrochlore.

10. A method of adding to molten iron-base alloy a metal selected from the group consisting of Nb, Mo, Cr and W, said method comprising immersing in molten iron-base alloy an addition agent consisting essentially of an agglomerated blended mixture of about 20 to 80% by weight of a finely divided oxide of a metal selected from the group consisting of Nb, Mo, Cr and W with about 20 to 30% by weight of a finely divided calcium bearing material selected from calcium-silicon alloy, calcium carbide and calcium cyanamide.

11. A method of adding to molten iron-base alloy a metal selected from the group consisting of Nb, Mo, Cr and W, said method comprising preparing an addition agent consisting essentially of an agglomerated blended mixture of about 20 to 80% by weight of a finely divided oxide of one of said metals with about 20 to 80% by weight of a finely divided calcium-bearing material selected from the group consisting of calcium-silicon alloy, calcium carbide and calcium cyanamide, and then rapidly immersing the addition agent into the molten iron-base alloy so as to avoid any significant exposure of the addition agent to oxidizing conditions.

12. A method in accordance with claim 11 wherein the addition agent is immersed into the molten iron-base alloy in a manner such as to avoid substantial contact with any slag-like materials present on the surface of the molten metal.

* * * * *

UNITED STATES PATENT AND TRADEMARK OFFICE

CERTIFICATE OF CORRECTION

PATENT NO. : 4,373,948

DATED : February 15, 1983

INVENTOR(S) : Gloria M. Faulring, Alan Fitzgibbon & Frank Slish

It is certified that error appears in the above—identified patent and that said Letters Patent is hereby corrected as shown below:

Column 3, line 4 (claim 1), "about" should be inserted after "mixture of".

Column 3, line 5 (claim 1), "about" should be deleted after "weight of" .

Column 4, line 58 (claim 10), "30%" should read -- 80% --.

Column 4, line 59 (claim 10), "the group consisting of" should be inserted after "selected from".

Column 4, line 57, (claim 10), delete "the group consisting of".

Signed and Sealed this

*Nineteenth* Day of *July 1983*

[SEAL]

*Attest:*

GERALD J. MOSSINGHOFF

*Attesting Officer*

*Commissioner of Patents and Trademarks*